US006835048B2

(12) United States Patent
Perkins et al.

(10) Patent No.: US 6,835,048 B2
(45) Date of Patent: Dec. 28, 2004

(54) ION PUMP HAVING SECONDARY MAGNETIC FIELD

(75) Inventors: Charles Perkins, Boston, MA (US); Barry Manley, Boulder, CO (US)

(73) Assignee: Varian, Inc., Palo Alto, CA (US)

( * ) Notice: Subject to any disclaimer, the term of this patent is extended or adjusted under 35 U.S.C. 154(b) by 29 days.

(21) Appl. No.: 10/322,991

(22) Filed: Dec. 18, 2002

(65) Prior Publication Data

US 2004/0120826 A1 Jun. 24, 2004

(51) Int. Cl.[7] ..... F04B 37/02; H01F 7/02
(52) U.S. Cl. ..... 417/49; 417/48; 335/306
(58) Field of Search ..... 417/48, 49; 335/306

(56) References Cited

U.S. PATENT DOCUMENTS 3,067,366 A * 12/1962 Hofman ..... 335/304
3,091,717 A * 5/1963 Rutherford et al. ..... 417/49
3,231,175 A * 1/1966 Zaphiropoulos ..... 417/49
3,416,722 A * 12/1968 Helmer ..... 417/49
3,994,625 A * 11/1976 Welch ..... 417/49
4,334,829 A * 6/1982 Harbaugh ..... 417/49
4,937,545 A * 6/1990 Chaillout et al. ..... 335/298
5,262,028 A * 11/1993 Manley ..... 204/192.12
6,004,104 A * 12/1999 Rutherford ..... 417/49

FOREIGN PATENT DOCUMENTS

EP 0 161 782 A1 4/1985

OTHER PUBLICATIONS

Publication Draft International Standard ISO/DIS 3556–1.2 entitled "Sputter–Ion Pumps—Measurement fo Performance Characteristics" published by International Organization for Standardization, 1992.

* cited by examiner

*Primary Examiner*—Cheryl J. Tyler
*Assistant Examiner*—Timothy P. Solak
(74) *Attorney, Agent, or Firm*—Bella Fishman

(57) ABSTRACT

An ion pump includes one or more anode pump cells, a cathode positioned in proximity to the one or more anode pump cells and a magnet assembly for producing a magnetic field in the one or more anode pump cells. An electric field is applied between the cathode and the one or more anode pump cells. The magnet assembly includes primary magnets of opposite polarities disposed on opposite ends of the anode pump cells and secondary magnets disposed on opposite sides of the anode pump cells. The magnet assembly may further include a magnet yoke which provides a magnetic flux return path. The magnet assembly produces a substantially uniform axial magnetic field in the one or more anode pump cells.

10 Claims, 9 Drawing Sheets

ION PUMP HAVING SECONDARY MAGNETIC FIELD

FIELD OF THE INVENTION

This invention relates to vacuum pumps known as sputter ion pumps and, more particularly, to a magnet assembly which provides improved sputter ion pump performance.

BACKGROUND OF THE INVENTION

The basic structure of a sputter ion pump includes an anode, a cathode, and a magnet. The anode includes one or more pump cells, which may be cylindrical. Cathode plates, typically titanium, are positioned on opposite ends of the pump cells. A magnet assembly produces a magnetic field oriented along the axis of the anode. A voltage, typically 3 kV to 9 kV, applied between the cathode plates and the anode produces an electric field which causes electrons to be emitted from the cathode. The magnetic field produces long, more or less helical electron trajectories. The relatively long helical trajectories of the electrons before reaching the anode improves the chances of collision with gas molecules inside the pump cells. When an electron collides with a gas molecule, it tends to liberate another electron from the molecule. The positive ions travel to the cathode due to the action of the electric field. The collision with the solid surface produces a phenomenon called sputtering, i.e., ejection of titanium atoms from the cathode surface. Some of the ionized molecules or atoms impact the cathode surface with sufficient force to penetrate the solid and to remain buried.

Prior art sputter ion pumps have generally satisfactory performance. However, ion pumps typically exhibit decreased pumping speeds at low pressures. Furthermore, ion pumps may extinguish and provide no pumping action at all at very low pressures. The pumping speed of an anode pump cell varies depending on several parameters, including magnetic field strength.

Accordingly, there is a need for improved sputter ion pumps and for magnet assemblies for sputter ion pumps.

SUMMARY OF THE INVENTION

According to a first aspect of the invention, a magnet assembly is provided for use in an ion pump. The magnet assembly comprises a magnet yoke having first and second sides and first and second ends which define an interior region, primary magnets of opposite polarities disposed on the first and second ends of the magnet yoke, and secondary magnets disposed on the first and second sides of the magnet yoke.

The secondary magnets may comprise magnets of opposite polarities disposed on the first side of the magnet yoke and magnets of opposite polarities disposed on the second side of the magnet yoke. Each of the secondary magnets is located adjacent to a primary magnet of like polarity.

The magnet assembly may be utilized with any sputter ion pump configuration. For example, the magnet assembly may be utilized with diode ion pumps and triode ion pumps. Furthermore, the magnet assembly may be utilized with ion pumps having any anode cell configuration.

According to another aspect of the invention, an ion pump comprises one or more anode pump cells, a cathode positioned in proximity to the one or more anode pump cells and a magnet assembly for producing a magnetic field in the one or more anode pump cells. An electric field is applied between the cathode and the one or more anode pump cells.

The magnet assembly comprises primary magnets of opposite polarities disposed on opposite ends of the anode pump cells, and secondary magnets disposed on opposite sides of the anode pump cells.

According to a further aspect of the invention, a method is provided for operating an ion pump that includes one or more anode pump cells and a cathode. The method comprises applying an electric field between the cathode and the one or more anode pump cells, and producing a magnetic field in the anode pump cells with a magnet assembly including primary magnets on opposite ends of the anode pump cells and secondary magnets on opposite sides of the anode pump cells.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
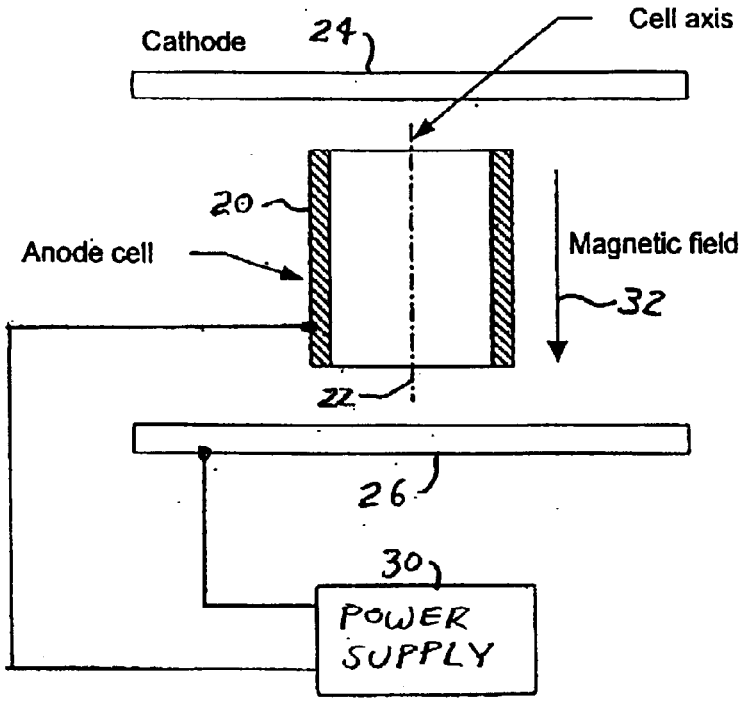
FIG. 1 PRIOR ART
FIG. 1 is a schematic diagram of a prior art ion pump cell.

A schematic diagram of a prior art ion pump cell is shown in FIG. 1. A cylindrical anode cell 20 has a cell axis 22. Anode cell 20 may be fabricated of stainless steel, for example. Cathode plates 24 and 26 are positioned at opposite ends of anode cell 20 and may be perpendicular to cell axis 22. A power supply 30 applies a voltage, typically 3 kV to 9 kV, between the cathode plates 24, 26 and the anode cell 20. A magnet assembly (not shown in FIG. 1) produces a magnetic field 32 in anode cell 20 parallel to cell axis 22.

Figure 2:
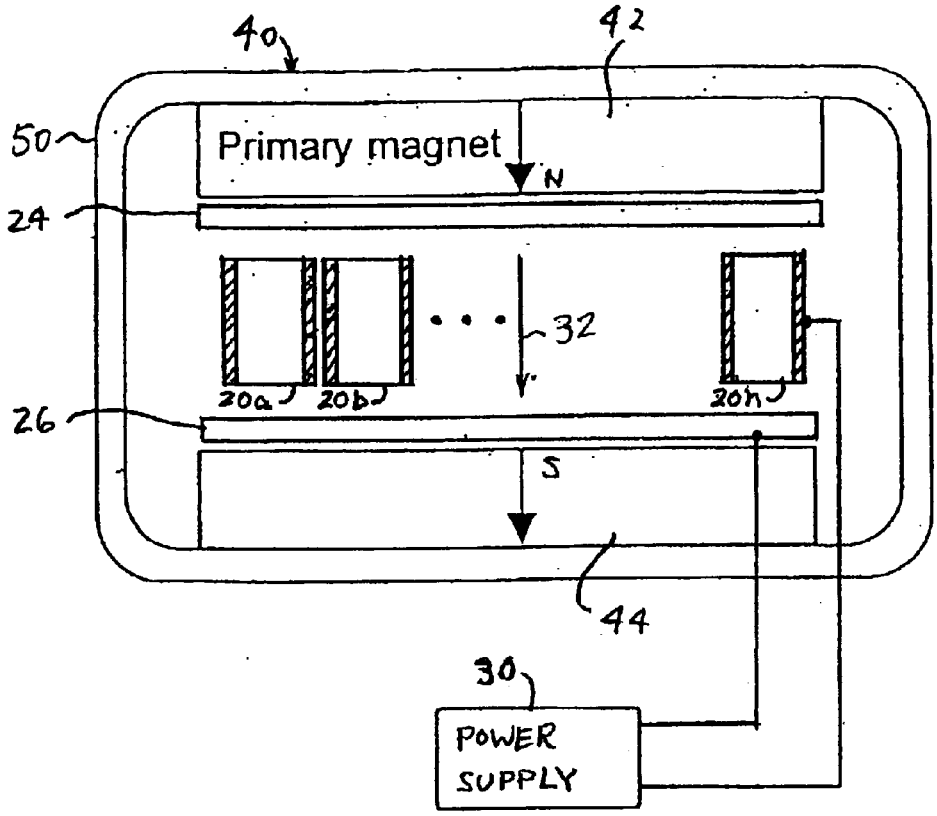
FIG. 2 PRIOR ART
FIG. 2 is a simplified schematic diagram of a prior art sputter ion pump.

A schematic diagram of a prior art sputter ion pump having multiple anode cells is shown in FIG. 2. Like elements in FIGS. 1 and 2 have the same reference numerals. The sputter ion pump of FIG. 2 includes multiple anode cells 20*a*, 20*b*, . . . 20*n* located between cathode plates 24 and 26. Power supply 30 is connected between cathode plates 24, 26 and anode cells 20*a*, 20*b*, . . . 20*n*. A magnet assembly 40 includes primary magnets 42 and 44 located on opposite ends of anode cells 20*a*, 20*b*, . . . 20*n*. Primary magnet 42 may have a north pole facing anode cells 20*a*, 20*b*, . . . 20*n*, and primary magnet 44 may have a south pole facing anode cells 20*a*, 20*b*, . . . 20*n*. A magnet yoke 50 of magnetic material provides a return path for magnetic fields between primary magnets 42 and 44. In the configuration of FIG. 2, magnet yoke 50 has a generally rectangular shape. In other prior art sputter ion pumps, the magnet yoke may be U-shaped, with an open side. Primary magnets 42 and 44 produce magnetic field 32 in the region of anode cells 20*a*, 20*b*, . . . 20*n*. The entire assembly shown in FIG. 2 may be enclosed in a vacuum enclosure.

The voltage between cathode plates 24, 26 and anode cells 20*a*, 20*b*, . . . 20*n* results in the generation of free electrons in the anode cell volume. These free electrons ionize gas molecules that enter the anode cells. The ionized gas molecules are accelerated to the cathode plates, usually made of titanium or tantalum, resulting in sputtering of the cathode material onto surfaces of the anode cells. The sputtered cathode material readily pumps gas molecules and is the primary pumping mechanism in the ion pump. Secondary electrons produced from the ionization process sustain the plasma in the anode cells so that the pumping action is continuous. The magnetic field axial to the anode cells is required to maintain a long electron path and to sustain a stable plasma in the anode cells. The magnetic field strength and the field quality are important factors in obtaining high pumping speed in an ion pump.

Prior art ion pumps contain only two primary magnets per anode structure, as shown in FIG. 2, with one north pole and one south pole, placed parallel to each other at opposite ends of the anode cells. The resulting lines of magnetic flux pass through each anode cell. Near the center of the primary magnets, magnetic flux lines are parallel the anode cell axis. Near the edges of the primary magnets, however, the magnetic fields are perturbed and deviate from an axial alignment. The lines of magnetic flux deviate substantially from the cell axis near the edges of the primary magnets, resulting in reduced pumping speed for those locations. Calculations indicate that the magnetic field strength varies from approximately 1,300 gauss at the center of the primary magnets to approximately 600 gauss at the edges of the primary magnets, resulting in further decreased pumping speed for the anode cells in the low field regions.

Figure 3:
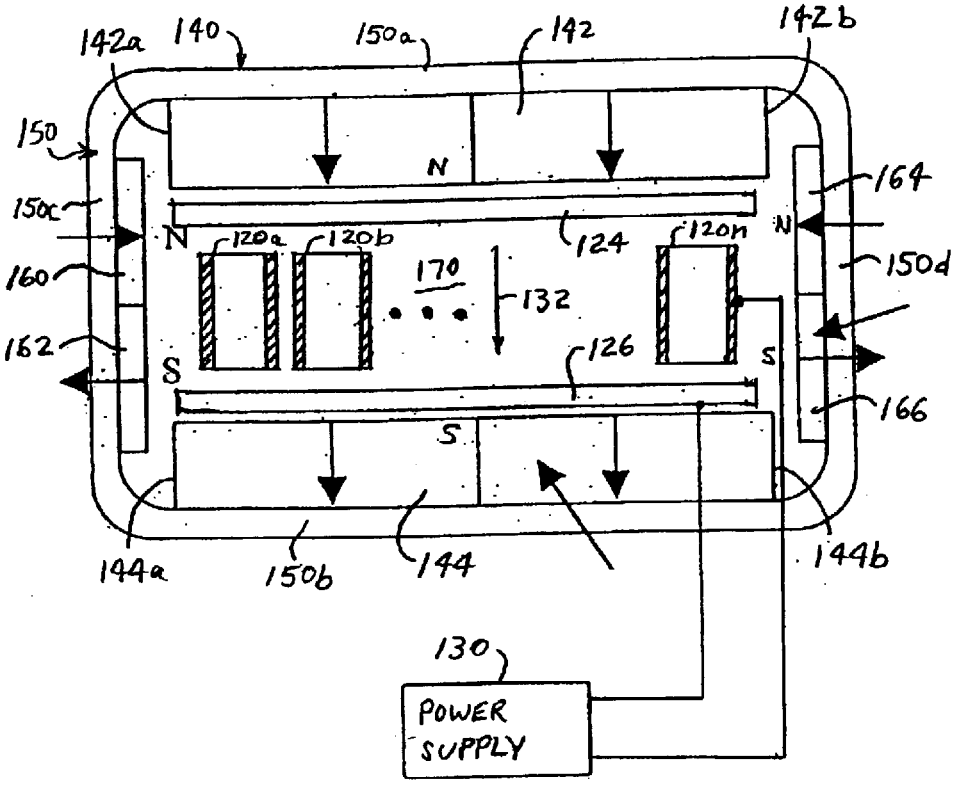
FIG. 3 is a simplified schematic diagram of a sputter ion pump in accordance with an embodiment of the invention.

A simplified schematic diagram of a sputter ion pump in accordance with an embodiment of the invention is shown in FIG. 3. Anode cells 120*a*, 120*b*, . . . 120*n* are located between and are spaced from cathode plates 124 and 126. The ion pump may include one or more anode cells. Each anode cell may have a cylindrical configuration and may be fabricated of stainless steel. The anode cells 120*a*, 120*b*, . . . 120*n* are oriented with their axes parallel to each other and perpendicular to cathode plates 124, 126. Cathode plates 124 and 126 may be fabricated of titanium or tantalum, for example. A power supply 130 applies a voltage, typically 3 kV to 9 kV, between cathode plates 124, 126 and anode cells 120*a*, 120*b*, . . . 120*n*. Cathode plates 124 and 126 are electrically connected together, and anode cells 120*a*, 120*b*, . . . 120*n* are electrically connected together. Cathode plates 124 and 126 may be connected to a reference voltage, such as ground, in this embodiment.

A magnet assembly 140 includes primary magnets 142 and 144 located on opposite ends of anode cells 120*a*, 120*b*, . . . 120*n*, and a magnet yoke 150. In addition, magnet assembly 140 includes secondary magnets 160, 162, 164 and 166 located on the sides of anode cells 120*a*, 120*b*, . . . 120*n* near the edges of primary magnets 142 and 144. As shown, primary magnet 142 may have a north pole facing anode cells 120*a*, 120*b*, . . . 120*n*, and primary magnet 144 may have a south pole facing anode cells 120*a*, 120*b*, . . . 120*n*. Secondary magnets 160 and 164 may have north poles facing the anode cells and are located on opposite sides of the anode cells adjacent to edges 142*a* and 142*b*, respectively, of primary magnet 142. Secondary magnets 162 and 166 may have south poles facing the anode cells and are located on opposite sides of the anode cells adjacent to edges 144*a* and 144*b*, respectively, of primary magnet 144. The arrangement of primary magnets 142 and 144 and secondary magnets 160, 162, 164 and 166 produces a magnetic field 132 in anode cells 120*a*, 120*b*, . . . 120*n* of substantially uniform strength and substantially uniform axial direction and thereby increases the pumping speed of the sputter ion pump. Preferably, the magnetic field is uniform in strength within about 10% across the anode cells and is uniform in axial direction within about 15 degrees across the anode cells. However, the invention is not limited to these ranges.

As shown in FIG. 3, magnet yoke 150 may have a generally rectangular configuration including ends 150*a*, 150*b* and sides 150*c*, 150*d*, which define an interior region 170 that contains the primary and secondary magnets, the cathode plates and the anode cells. In the embodiment of FIG. 3, primary magnet 142 is affixed to an inner surface of end 150*a* of magnet yoke 150, and primary magnet 144 is affixed to an inner surface of end 150*b* of magnet yoke 150. Secondary magnets 160 and 162 are affixed to an inner surface of side 150*c* of magnet yoke 150, and secondary magnets 164 and 166 are affixed to an inner surface of side 150*d* of magnet yoke 150. Thus, magnets 160 and 162 of opposite polarities are located on side 150*c* of magnet yoke 150, and secondary magnets 164 and 166 of opposite polarities are located on side 150*d* of magnet yoke 150. Each of the secondary magnets 160, 162, 164 and 166 is located adjacent to a primary magnet of like polarity.

Figure 4:
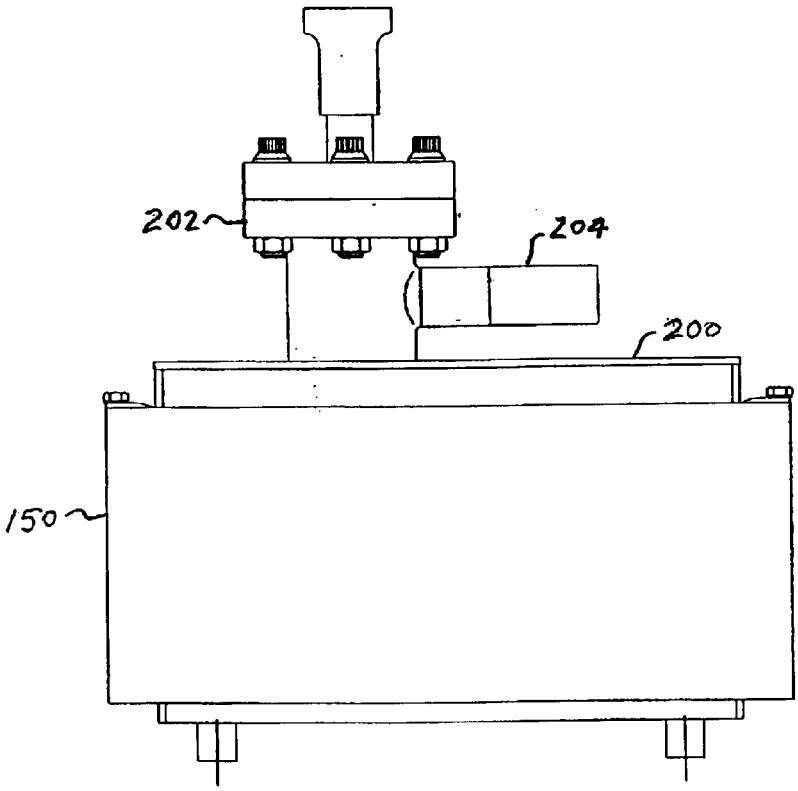
FIG. 4 is a side view of an embodiment of a sputter ion pump in accordance with an embodiment of the invention.
Figure 5:
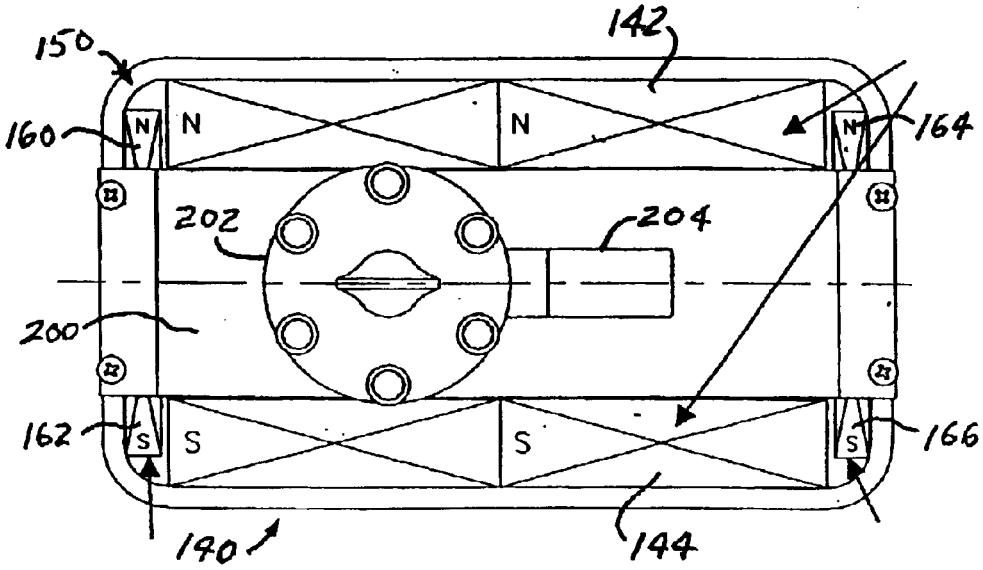
FIG. 5 is a top view of the sputter ion pump shown in FIG. 4.

Side and top views of an embodiment of a sputter ion pump assembly incorporating the features of FIG. 3 are shown in FIGS. 4 and 5, respectively. Like elements in FIGS. 3–5 have the same reference numerals. A vacuum enclosure 200 having a connecting flange 202 encloses the region of cathode plates 124, 126 and anode cells 120*a*, 120*b*, . . . 120*n*. A high voltage feedthrough 204 permits connection of power supply 130 to cathode plates 124, 126 and anode cells 120*a*, 120*b*, . . . 120*n*. The components of magnet assembly 140 may be located external to vacuum enclosure 200, as best shown in FIG. 5.

The secondary magnets 160, 162, 164 and 166 shown in FIG. 3 and described above optimize the magnetic field strength and field shape in the area of anode cells 120*a*, 120*b*, . . . 120*n*. The improved magnet assembly achieves a higher magnetic field strength as compared to prior art ion pumps, which directly yields higher pumping speed. In addition, the improved magnet assembly provides a high field quality across the full pole width of the primary magnets 142, 144, so that all of the anode cells pump at high speed. Good field alignment and high field strength are maintained cross the full width of primary magnets 142, 144. Both of these characteristics result in increased pumping speed, especially at low vacuum pressure.

Figure 6:
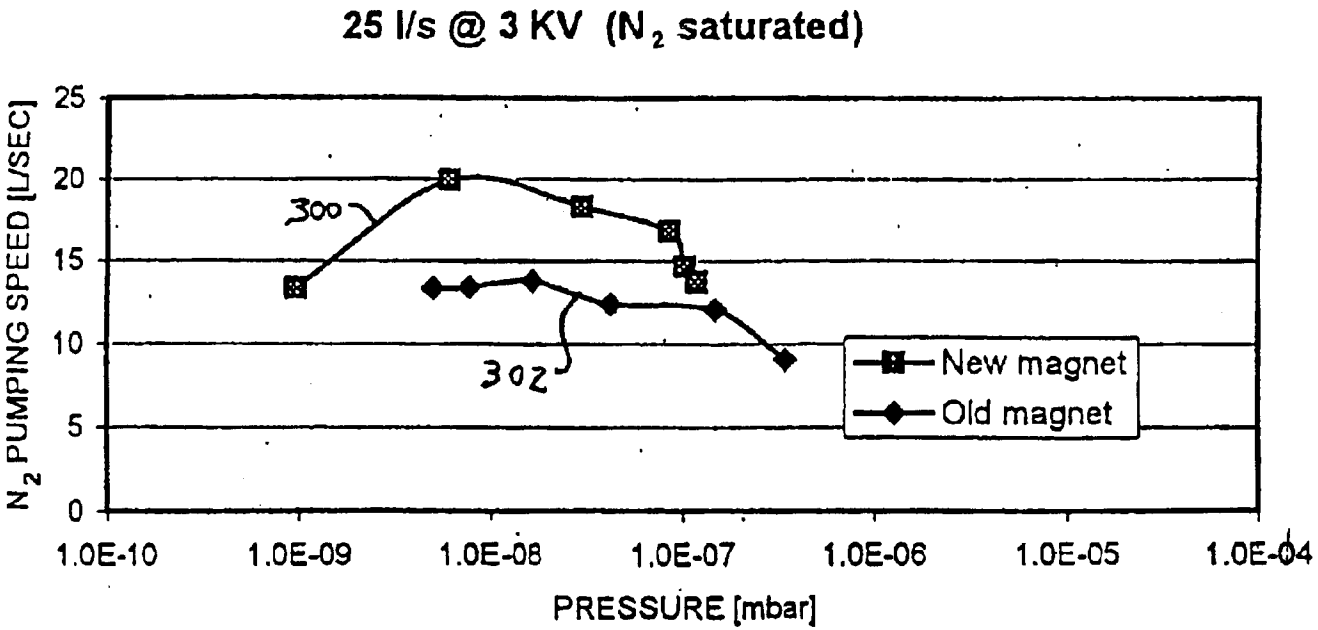
FIGS. 6–8 are graphs of nitrogen pumping speed in liters per second as a function of pressure for a prior art magnet assembly and for magnet assemblies in accordance with embodiments of the invention, at different operating voltages.
Figure 7:
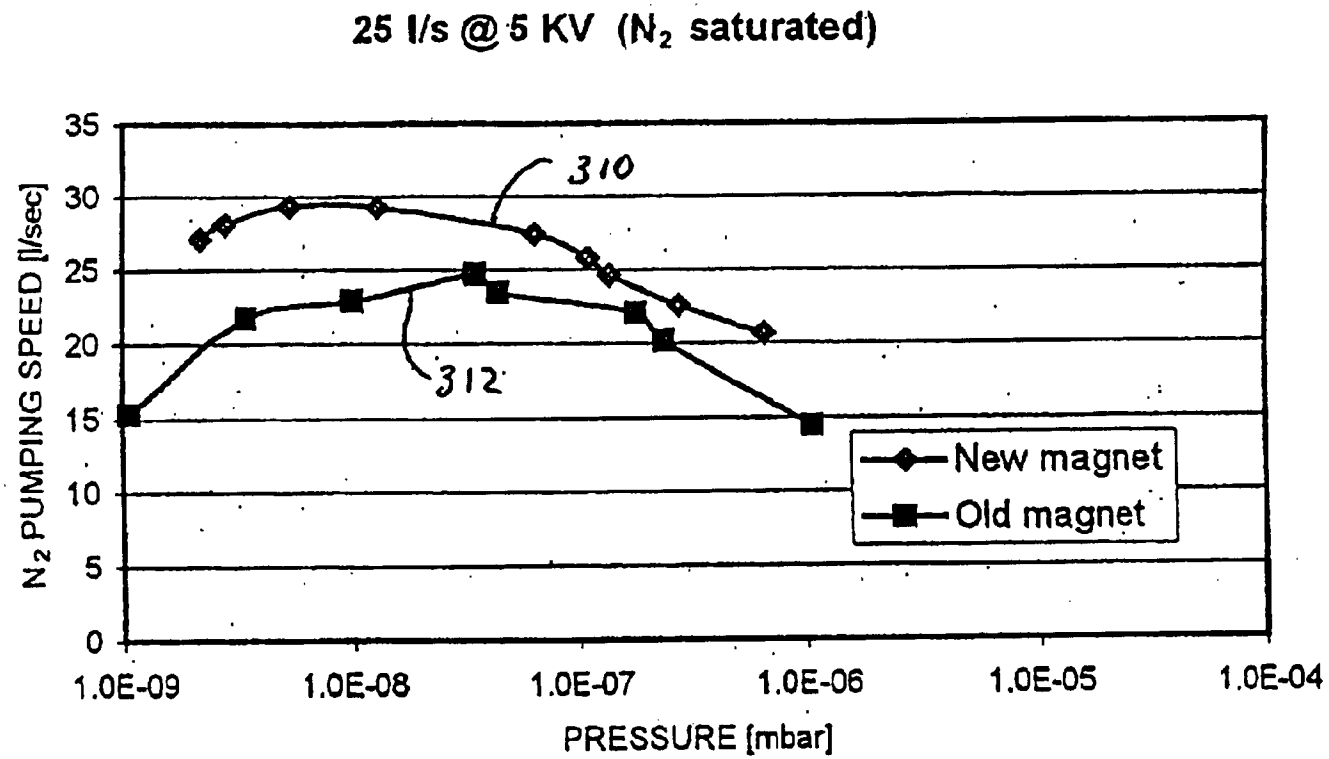
Figure 8:
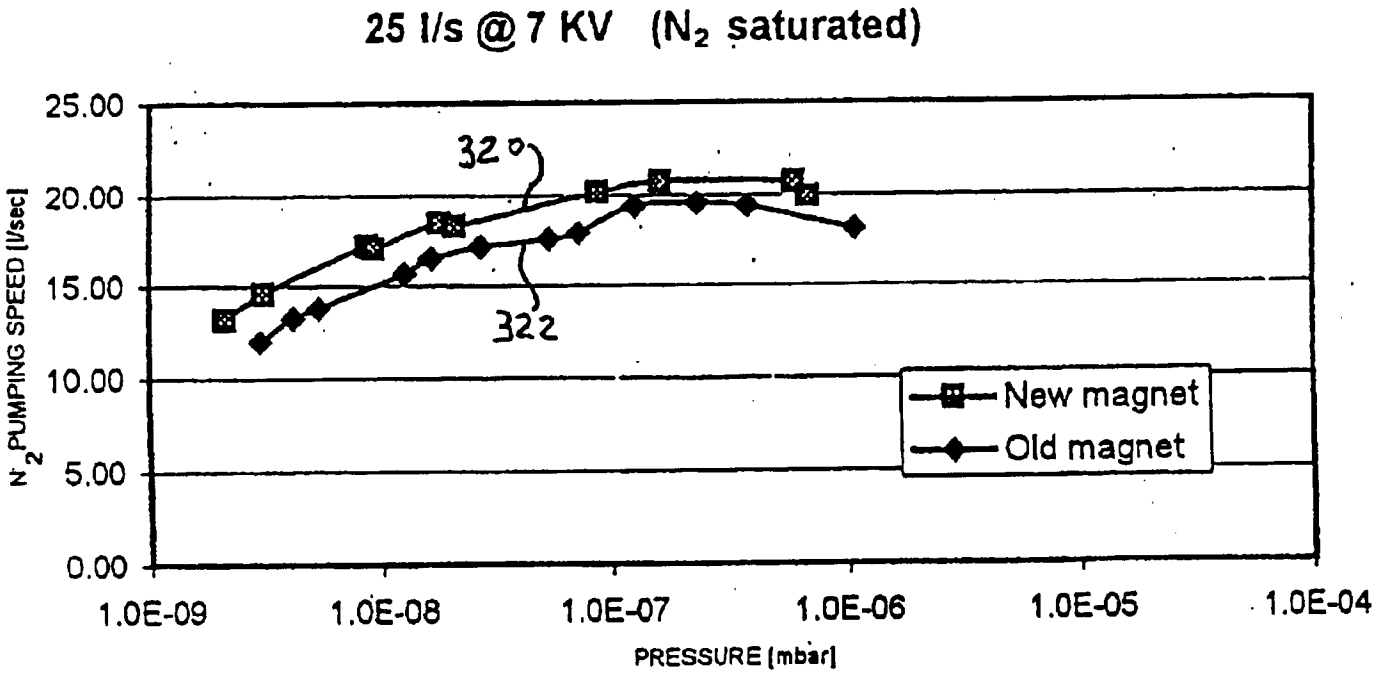

FIGS. 6, 7 and 8 show measured nitrogen pumping speed of 25 liters/second ion pumps using a magnet assembly as shown in FIG. 3 and a prior art magnet assembly as shown in FIG. 2. The pumping speed is plotted as a function of inlet pressure in millibar (Torr). FIG. 6 illustrates operation at a power supply voltage of 3 kV, FIG. 7 illustrates operation at a power supply voltage of 5 kV, and FIG. 8 illustrates operation at a power supply voltage of 7 kV. The ion pumping speed was measured in a Fischer-Momsen dome in accordance with ISO/DIS 3556-1.2. In FIG. 6, curve 300 represents the ion pumping speed with the magnet assembly of FIG. 3, and curve 302 represents the pumping speed with the magnet assembly of FIG. 2. In FIG. 7, curve 310 represents the pumping speed with the magnet assembly of FIG. 3, and curve 312 represents the pumping speed with the magnet assembly of FIG. 2. In FIG. 8, curve 320 represents the pumping speed with the magnet assembly of FIG. 3, and curve 322 represents the pumping speed with the magnet assembly of FIG. 2. The pumping speed with the improved magnet assembly of FIG. 3 is higher at all vacuum pressures and for a wide range of operating voltages.

The pumping speed of an anode cell varies depending on several parameters. However, one of the main parameters in the pumping speed equation is the magnetic field strength. The improved magnet assembly described above yields increased pumping speed for several reasons. As known in the art, two ion pumping modes are associated with sputter ion pumps. These are HMF (high magnetic field mode) and LMF (low magnetic field mode), with the highest ion pumping speed achieved in the HMF mode. The transition from HMF to LMF mode occurs at a critical vacuum pressure and magnetic field transition point calculated by the following equation.

$$B_{tr}=7.63\times\sqrt{\mathrm{Ua}/(\mathrm{Ra}\times P^{0.05})}$$

where Ua is the applied voltage, Ra is the anode cell radius and P is the vacuum pressure. As the vacuum pressure is reduced to lower pressures, the transition point increases. At some point, the transition point value exceeds the actual magnetic field strength in the cell. The pumping action changes from HMF to LMF mode and the effective ion pumping speed is reduced. It is therefore desirable to sustain the HMF mode to as low a pressure as possible. A high magnetic field strength in the anode cells, above the transition point, sustains the HMF pumping mode and the highest pumping speed to lower vacuum pressure.

When the transition magnetic field exceeds the actual magnetic field strength in the anode cell volume, LMF pumping mode is initiated. The LMF mode is the primary pumping mode low vacuum pressures. The pumping speed S in LMF mode is given by:

$$S=1.56E\text{-}05\times(1-((1.5E06\times P)/(1+(4.0E06\times P)))\times(P^{0.2})\times(La)\times(Ra^2)\times(B^2)$$

where P is the vacuum pressure, La is the anode cell length, Ra is the anode cell radius, and B is the magnetic field strength in gauss. It can be seen that the speed increases as the second power of magnetic field strength, so even a small increase in magnet strength can yield a large increase in LMF pumping speed. For both of the above reasons, higher ion pumping speed is achieved when magnetic field strength is increased.

In addition, the quality of the magnetic field is important for high pump speed. If the strength of the magnetic field varies across a group of anode cells, the pumping action is reduced where the field is lower or where the lines of magnetic flux deviate from axial alignment with the anode cells. In prior art ion pump magnet assemblies, both reduced field strength and field misalignment occur near the edges of the primary magnets, so pumping speed in the anode cells near the edges of the primary magnets is reduced. The improved magnet assembly disclosed herein provides quite constant field quality over the full width of the primary magnets so that high speed is sustained in all pump cells. This yields a high integrated pumping speed in a working pump.

Furthermore, at low vacuum pressures, such as $10^{-8}$ Torr or less, there are few gas molecules in the anode cell volume to be ionized. Therefore, fewer secondary electrons are produced to sustain the plasma and the ion pumping action. Some anode cells can be extinguished and provide no pumping action at all. A high magnetic field is more effective in trapping electrons in the cell volume, thereby sustaining the pumping action more effectively at lower vacuum pressure, for example $10^{-9}$ to $10^{-12}$ Torr.

As a secondary effect, starting of the ion pump is also improved. Ion pumps are difficult to start at vacuum pressures below $10^{-7}$ Torr, as the probability of an ionizing event that would initiate the plasma is low. The higher magnetic field traps electrons more effectively and greatly improves ionization in the pump cells and therefore improves starting of the ion pump.

The embodiment of FIGS. 3–5 includes six magnets, including two primary magnets and four secondary magnets. The primary magnets provide the primary magnetic field in the area of the anode cells. The primary magnets 142 and 144 may be single pieces of magnetic material on opposite ends of the magnet yoke 150, one north and one south pole. Each primary magnet may include two or more magnet elements located side by side. The latter configuration may have lower cost of fabrication. A preferred embodiment uses ferrite magnets, but may also use electromagnets or rare earth magnets, such as samarium-cobalt. The anode cells may be in a range of about 1–50 millimeters (mm) in radius and about 1–50 mm in length. A preferred embodiment includes six magnets as shown in FIG. 3. However, the magnet assembly may utilize ten magnets, with two additional secondary magnets on the top of the anode structure and two additional secondary magnets on the bottom of the anode structure to form a six-sided magnetic box, which further contains the magnetic fields in the area of the anode cells. The magnets may be about 1–50 mm in thickness and slightly larger than the ion pump anode structure in width and height. Alternatively, magnetic steel plates may be utilized on the top and bottom of the anode structure to contain the magnetic field, reduce stray magnetic fields in the area around the outside of the pump volume and to provide a more uniform field in the volume of the anode cells. A preferred embodiment may utilize a primary pole gap from one centimeter to several centimeters in width. The entire ion pump assembly may be enclosed in a vacuum enclosure and mounted to a vacuum system with a connecting flange or may be integrated inside a large vacuum system.

The magnet yoke 150 provides a magnetic flux return path. The yoke is configured to concentrate the magnetic flux return in the yoke to maximize the field strength between the magnet poles in the anode cell volume. This configuration also reduces stray magnetic fields outside the pump volume that might interfere with any system on which the ion pump is installed, such as a charged particle beam in a scientific instrument, a particle accelerator or an RF power tube. The yoke 150 may be made from a highly permeable material such as AISI 1006 or AISI 1010 low carbon steel or a commercial alloy steel. The thickness and width of the primary and secondary magnets, the thickness and shape of the magnet yoke and the distance between magnets can be varied to optimize the magnetic field strength and field quality. This optimization may be required for ion pumps with different pumping requirements, different gas species, different operating pressures, and different physical space requirements.

Figure 9:
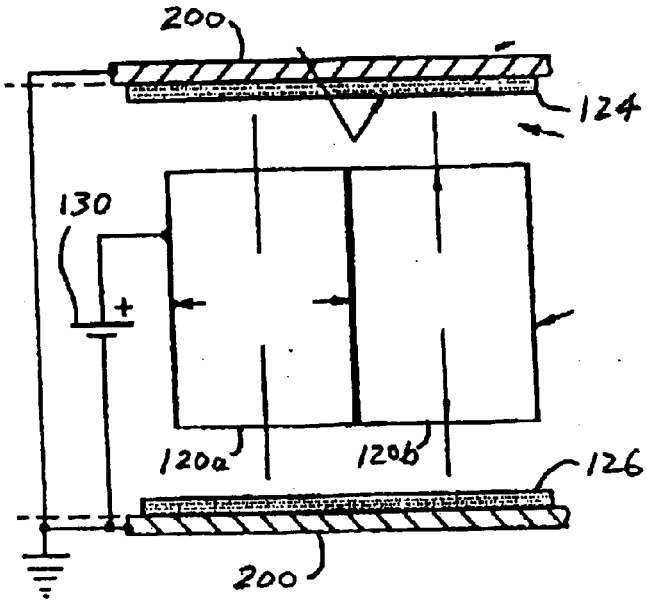
FIG. 9 is a simplified schematic diagram of a diode sputter ion pump.

A variety of different sputter ion pump configurations are known in the art. FIG. 9 shows a simplified schematic diagram of a diode sputter ion pump, which corresponds to the sputter ion pump shown in FIGS. 3–5 and described above. Like elements in FIGS. 3–5 and 9 have the same reference numerals. The magnet assembly is omitted from FIG. 9 for ease of illustration. However, the diode sputter ion pump of FIG. 9 may include a magnet assembly as shown in FIGS. 3–5 and described above.

As shown in FIG. 9, cathode plates 124 and 126 are affixed to vacuum enclosure 200, and vacuum enclosure 200 is connected to a reference voltage, such as ground. Anode cells 120*a*, 120*b*, etc., are biased at a positive voltage by power supply 130. Cathode plates 124 and 126 are spaced from anode cells 120*a*, 120*b*, etc.

Figure 10:
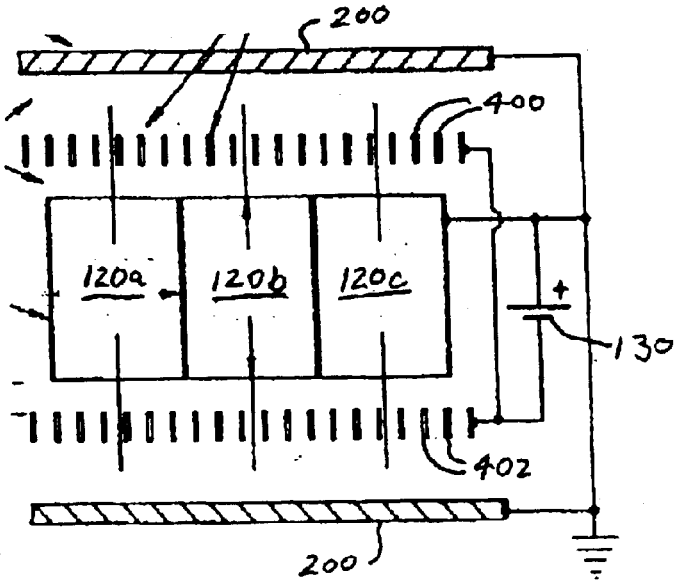
FIG. 10 is a simplified schematic diagram of a triode sputter ion pump.

A schematic diagram of a triode sputter ion pump is shown in FIG. 10. Like elements in FIGS. 9 and 10 have the same reference numerals. The triode sputter ion pump includes a grid cathode 400 spaced from a first end of anode cells 120*a*, 120*b*, . . . 120*n* and a grid cathode 402 spaced from a second end of anode cells 120*a*, 120*b*, . . . 120*n*. Grid cathodes 400 and 402 are spaced from vacuum enclosure 200. In the triode ion pump of FIG. 10, anode cells 120*a*, 120*b*, . . . 120*n* and vacuum enclosure 200 are connected to a reference voltage, such as ground. Grid cathodes 400 and 402 are biased at a negative voltage by power supply 130.

The sputter ion pump has been described above as having cylindrical anode cells. However, a number of different anode cell configurations are known in the art. In general, the anode cells may have a cross-section that is round, square or arbitrarily shaped. A sputter ion pump configuration known as "Starcell" utilizes cathodes formed with a star-like pattern. The Starcell sputter ion pump is manufactured and sold by Varian, Inc. Another anode cell configuration utilizes multiple metal strips formed into a wave-like configuration and attached together to form anode cells. The cross-sectional shapes of the anode cells depend on the shapes of the component metal strips, but may resemble an oval or a deformed circle.

It will be understood that the magnet assembly shown in FIGS. 3–5 and described above may be utilized with any sputter ion pump configuration, including but not limited to the diode configuration and the triode configuration. Furthermore, the magnet assembly shown in FIGS. 3–5 and described above may be utilized with any anode cell configuration. The magnet assembly described herein may be utilized with any sputter ion pump configuration to provide a magnetic field of substantially uniform strength and substantially uniform axial direction in the anode cells.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An ion pump comprising:

one or more anode pump cells;

a cathode positioned in proximity to the one or more anode pump cells, wherein an electric field is applied between the cathode and the one or more anode pump cell; and a magnet assembly for producing a magnetic field in the one or more anode pump cells, said magnet assembly comprising:

primary magnets of opposite polarities disposed on opposite ends of the anode pump cells; and secondary magnets disposed on opposite sides of the anode pump cells, wherein said magnet assembly providing substantially uniform axial magnetic field and increased magnetic field strength across said one or more anode pump cells yielding increased pumping speed therein.

2. The ion pump as defined in claim 1, wherein said magnet assembly further comprises a magnet yoke having first and second sides and first and second ends which define an interior region.

3. The ion pump as defined in claim 2, wherein said primary magnets are disposed on the first and second ends of the magnet yoke and wherein said secondary magnets are disposed on the first and second sides of the magnet yoke.

4. The ion pump as defined in claim 3, wherein said secondary magnets comprise magnets of opposite polarities disposed on the first side of the magnet yoke and magnets of opposite polarities disposed on the second side of the magnet yoke, wherein each of the secondary magnets is located adjacent to a primary magnet of like polarity.

5. The ion pump as defined in claim 1, wherein said primary magnets and said secondary magnets are configured to produce a substantially uniform magnetic field in the one or more anode pump cells.

6. The ion pump as defined in claim 1, wherein said one or more anode pump cells have first and second ends and wherein laid primary magnets are spaced from the first and second ends of the anode pump cells.

7. The ion pump as defined in claim 1, wherein said cathode comprises cathode plates spaced from first and second ends of the one or more anode cells.

8. The ion pump as defined in claim 1, further comprising a power supply coupled between the cathode and the one or more anode pump cells.

9. The ion pump as defined in claim 1, wherein said one or more anode pump cells and said cathode have a diode ion pump configuration.

10. The ion pump as defined in claim 1, wherein said one or more anode pump cells and said cathode have a triode ion pump configuration.

* * * * *